US005202653A

United States Patent [19]

Yamada et al.

[11] Patent Number: 5,202,653

[45] Date of Patent: Apr. 13, 1993

[54] BAND-PASS FILTER INCLUDING RESONANCE ELEMENTS COUPLED BY A COUPLING LINE AND A BY-PASS COUPLING LINE

[75] Inventors: Yasuo Yamada; Tadahiro Yorita; Hitoshi Tada, all of Nagaokakyo, Japan

[73] Assignee: Murata Manufacturing Co., Ltd., Japan

[21] Appl. No.: 686,193

[22] Filed: Apr. 16, 1991

[30] Foreign Application Priority Data

Apr. 17, 1990 [JP] Japan ..... 2-101090
Jun. 29, 1990 [JP] Japan ..... 2-174193

[51] Int. Cl.[5] ..... H01P 1/20; H01P 1/202
[52] U.S. Cl. ..... 333/202; 333/206
[58] Field of Search ..... 333/202, 203, 206, 207, 333/222, 134, 174, 175, 176, 185, 170

[56] References Cited

U.S. PATENT DOCUMENTS 4,740,765 4/1988 Ishikawa et al. ..... 333/206
4,757,285 7/1988 Krause ..... 333/203
4,800,347 1/1989 Yorita et al. ..... 333/202

FOREIGN PATENT DOCUMENTS 0191101 8/1986 Japan ..... 333/206
0193501 8/1986 Japan ..... 333/206
0237501 10/1986 Japan ..... 333/202
0224502 9/1988 Japan ..... 333/202
0078001 3/1989 Japan ..... 333/204
0062101 3/1990 Japan ..... 333/202
2234398 1/1991 United Kingdom ..... 333/206

*Primary Examiner*—Robert J. Pascal
*Assistant Examiner*—Seung Ham
*Attorney, Agent, or Firm*—Ostrolenk, Faber, Gerb & Soffen

[57] ABSTRACT

A band-pass filter which includes a plurality of dielectric coaxial resonators which are arranged in a parallel relation and extending axially in the same direction, and have respective coupling terminals inserted therein, and a dielectric substrate formed, on its first surface, with a plurality of coupling electrodes for connecting the respective coupling terminals. The coupling electrodes on the first surface of the dielectric substrate have an inductance element between them for connecting at least two coupling electrodes to each other. Confronting electrodes facing the coupling electrodes are formed on the other surface of the dielectric substrate to from a capacitance bypass circuit. The inductance element may be a printed circuit on the dielectric substrate or an air-core coil. The air-core coil may be located either adjacent the first surface of the substrate, or away from the substrate between the resonators.

19 Claims, 5 Drawing Sheets

BAND-PASS FILTER INCLUDING RESONANCE ELEMENTS COUPLED BY A COUPLING LINE AND A BY-PASS COUPLING LINE

BACKGROUND OF THE INVENTION

The present invention generally relates to a band-pass filter employing parallel resonance circuit elements and more particularly, to circuit constructions and actual constructions of such band-pass filters.

As one example of band-pass filters of this kind, there has been conventionally available a band-pass filter having a circuit construction as shown in FIG. 8, with an actual construction as illustrated in FIGS. 9(A) and 9(B).

More specifically, as shown in the circuit construction of FIG. 8, the known band-pass filter has a plurality of dielectric coaxial resonators 1 (three dielectric coaxial resonators 1 in this example) as parallel connection resonance circuit elements, and a coupling line having coupling capacitors C as capacitance coupling elements, and connected to one end of each of said dielectric coaxial resonators 1.

Meanwhile, in the actual construction as shown in FIGS. 9(A) and 9(B), the known band-pass filter includes the plurality of dielectric coaxial resonators 1 (three resonators in this example), a rectangular flat plate-like dielectric substrate 2 and a case 3 in which said resonators 1 and substrate 2 are accommodated. The dielectric coaxial resonators 1 are arranged within the case 3 a parallel relation and directed in the same direction, with each of said dielectric coaxial resonators 1 having an inserted coupling terminal 4 connected for conduction with an inner conductor (not shown) of each dielectric coaxial resonator 1.

The dielectric substrate 2 is disposed at the side of open ends of said dielectric resonators 1 accommodated in the case 3 in the parallel relation to each other, and has coupling electrodes 5 formed at respective predetermined positions on its surface so as to be spaced from each other as shown. In other words, at respective positions of said dielectric substrate 2, the coupling capacitors C composed of said coupling electrodes 5 are formed. To each of the coupling electrodes 5 formed on the dielectric substrate 2, the other end of the coupling terminal 4 inserted in each of the dielectric coaxial resonators 1 is fixed by soldering.

In the conventional band-pass filter having the construction as described above, for providing an attenuation pole at the side of a frequency region higher than the pass-band frequency region thereof, it is necessary to insert an inductance coupling element L between the dielectric coaxial resonator 1 as the parallel resonance circuit element and the coupling capacitors C as the capacitance coupling elements as shown in FIG. 10. In the above case, for the actual construction, it is a general practice to connect an air-core coil 6 acting as an inductance coupling element L between the coupling terminal 4 connected with the inner conductor (not shown) of the required dielectric coaxial resonator 1 and the corresponding coupling electrode 5 formed on the dielectric substrate 2 as shown in FIGS. 11(A) and 11(B).

However, in the above known arrangement, the length of the band-pass filter in the direction of its depth (indicated by an arrow H in FIG. 11(A)) becomes undesirably longer by the extent of the air-core coil 6 thus inserted, with a consequent increase in the size of the band-pass filter on the whole.

SUMMARY OF THE INVENTION

Accordingly, an essential object of the present invention is to provide a band-pass filter which is capable of effectively preventing an increase of the filter's length in the direction of its depth when the inductance coupling element is provided for setting the attenuation pole, and consequently preventing an increase in the size of the filter on the whole.

Another object of the present invention is to provide a band-pass filter of the above described type which is simple in construction and stable in functioning, and can be readily manufactured on a large scale at low cost.

In accomplishing these and other objects, according to one preferred embodiment of the present invention, there is provided a fundamental circuit construction of a band-pass filter which includes a coupling line, a parallel resonance circuit element means, and a by-pass coupling line. The coupling line includes a capacitance coupling element means and an inductance coupling element means, with at least one of said capacitance coupling element means and at least one of said inductance coupling element means being connected in series with each other. At least one of said parallel resonance circuit element means is connected, at a first end, to a junction between said capacitance coupling element means and said inductance coupling element means, which are connected in series with each other. The by-pass coupling line has another capacitance coupling element means, and is connected in parallel with said coupling line.

More specifically, in the actual construction, the band-pass filter according to the present invention, includes a plurality of dielectric coaxial resonators which are arranged in a parallel relation in the same direction, and respectively inserted with coupling terminals, and a dielectric substrate formed, on its first surface, with a plurality of coupling electrodes for connecting said respective coupling terminals. The coupling electrodes on the first surface of said dielectric substrate are provided therebetween, with an inductance means for connecting said coupling electrodes to each other, with confronting electrodes facing said coupling electrodes being formed on the other surface of said dielectric substrate.

In a first aspect of the actual construction as referred to above, said inductance means is constituted by an inductance portion formed by printing between said coupling electrodes.

In a second aspect of the actual construction, said inductance means is constituted by an air-core coil attached between said coupling electrodes.

Further, in a third aspect of the actual construction, a gap is formed between said dielectric coaxial resonators arranged in the parallel relation and the air-core coil is provided in said gap.

BRIEF DESCRIPTION OF THE DRAWINGS

These and other objects and features of the present invention will become apparent from the following description of preferred embodiment thereof with reference to the accompanying drawings, in which:

FIGS. 1 to 7 relate to band-pass filters according to the present invention.

FIG. 1 is an equivalent circuit diagram showing a fundamental circuit construction of a band-pass filter according to the present invention, FIG. 2 is an explanatory diagram schematically showing construction of a coupling circuit in FIG. 1, FIG. 3 is a schematic top plan view showing an actual construction of the band-pass filter according to one preferred embodiment of the present invention, FIG. 4 is a top plan view showing a reverse surface of a dielectric substrate employed in the band-pass filter of FIG. 3, FIG. 5 is a view similar to FIG. 3, which particularly relates to a second embodiment thereof, FIG. 7 is a view similar to FIG. 6(A), which particularly shows a modification thereof, FIGS. 8 to 11(B) relate to conventional band-pass filters (already referred to).

DETAILED DESCRIPTION OF EMBODIMENTS OF THE INVENTION

Figure 1:
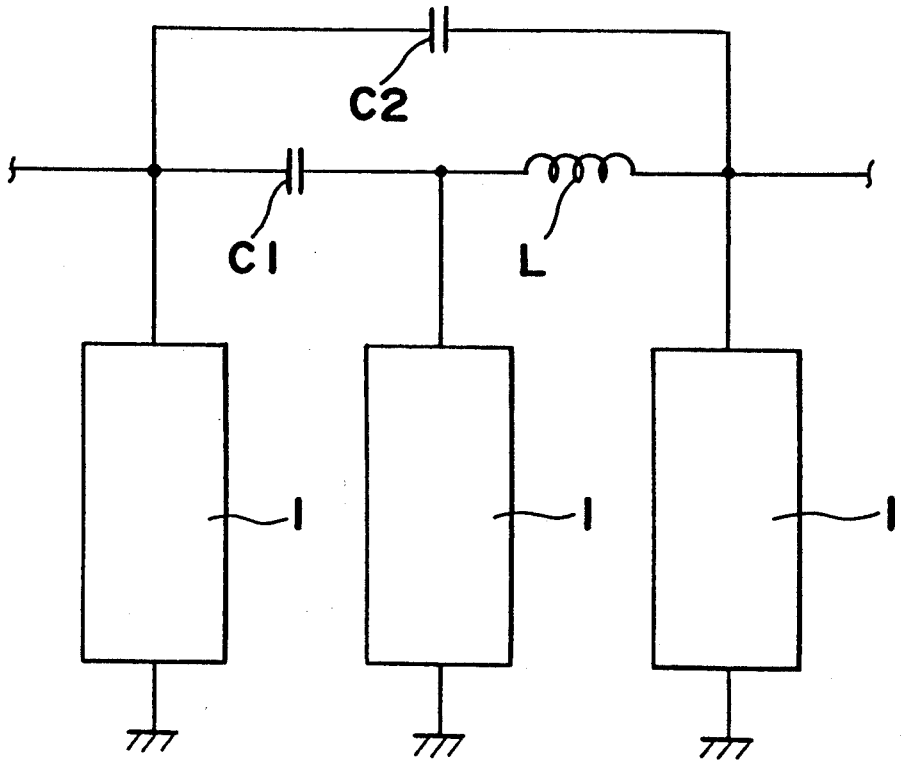

Before the description of the present invention proceeds, it is to be noted that like parts are designated by like reference numerals throughout the accompanying drawings.

Referring now to the drawings, there is shown in FIG. 1, a fundamental circuit construction of a band-pass filter according to the present invention.

In FIG. 1, the band-pass filter of the present invention basically includes a coupling line, a plurality of dielectric coaxial resonators 1 as parallel resonance circuit elements (three dielectric coaxial resonators 1 in FIG. 1), and a by-pass coupling line to be described more in detail hereinbelow. The coupling line referred to above has a coupling capacitor C1 as a capacitance coupling element and an inductance coupling element L, and said coupling capacitor C1 and said inductance coupling element L are connected in series to each other. An end portion of one of the dielectric coaxial resonators 1 is connected to a junction between the coupling capacitor C1 and the inductance coupling element L which are connected in series to each other, while end portions of other coaxial resonators 1 are respectively connected to corresponding ends of said coupling capacitor C1 and the coupling element L, to constitute the coupling line as shown. Meanwhile, the by-pass coupling circuit has a by-pass capacitor C2 as a capacitance coupling element, and this by-pass capacitor C2 is connected in parallel with the coupling circuit.

It is to be noted here that, in the above arrangement, the number of the dielectric coaxial resonators is not limited to being a plurality, but may be modified to be one depending on necessity.

For consideration of impedance of the coupling circuit having the coupling capacitor C1 as the capacitance coupling element, the by-pass capacitor C2, and the inductance coupling element L, the impedance value $Z_L$ of the inductance coupling element L is represented by A, the impedance value $Z_{c1}$ of the coupling capacitor C1 is denoted by $-A$, and the impedance value $Z_{c2}$ of the by-pass capacitor C2 is shown by $-B$. In this case, since the impedance value of the by-pass capacitor C2 must be higher than the impedance value $Z_{c1}$ of the coupling capacitor C1, the relation is represented by $B>A$.

Figure 2:
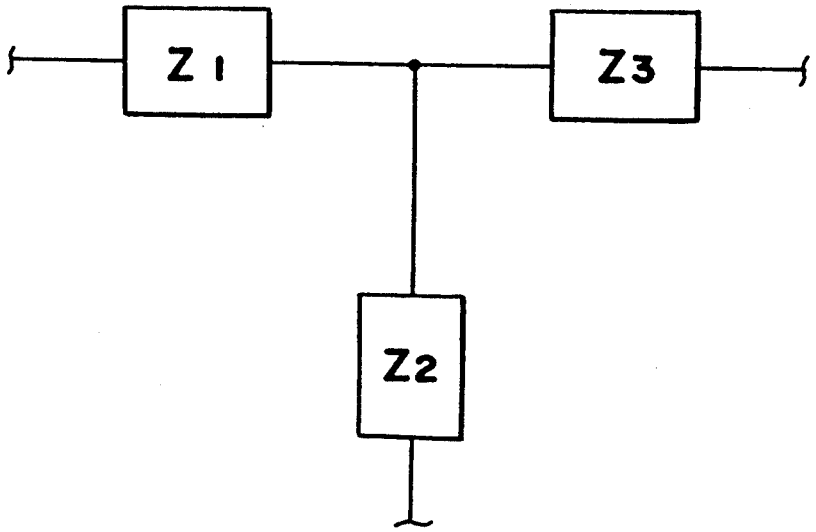

Therefore, when this coupling circuit is subjected to Δ-Y conversion, it may be represented as shown in a schematic explanatory diagram in FIG. 2, in which $Z_2$ may be given as $$Z_2=(Z_L \cdot Z_{c1})/(Z_L+Z_{C1}+Z_{C2})$$

$$\approx(-A \cdot B)/(-B)\approx A$$

In other words, the above $Z_2$ has an impedance characteristic, and the impedance value thereof becomes generally equal to that of the inductance coupling element L.

Figure 10:
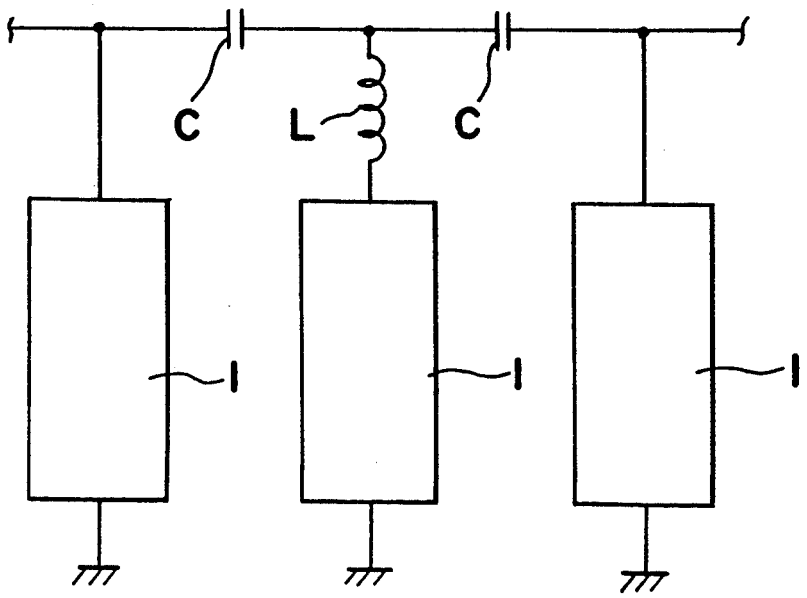
Fig. 10 PRIOR ART
FIG. 10 is an equivalent diagram similar to FIG. 8, which particularly shows another example thereof.
Figure 11:
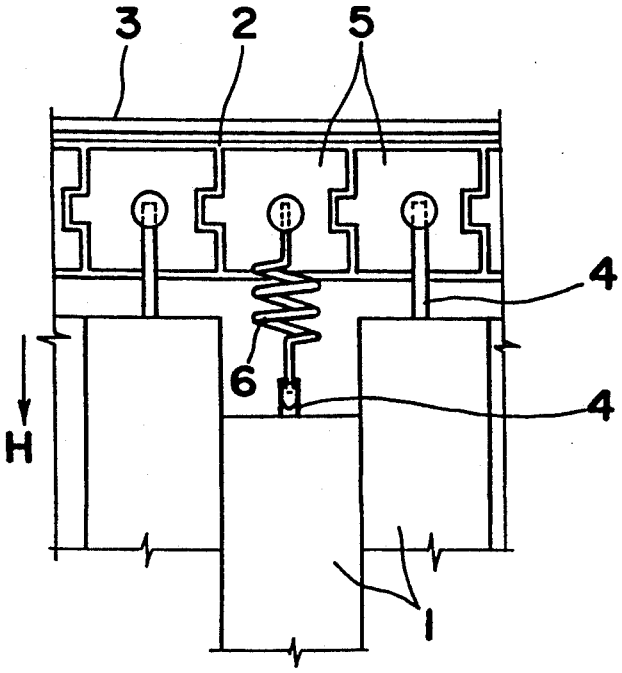
Fig. 11 (A) PRIOR ART
FIG. 11(A) is a schematic top plan view showing an actual construction of the conventional band-pass filter of FIG. 10.
FIG. 11(B) is a cross section of the conventional band-pass filter of FIG. 11(A).
Figure 11B:
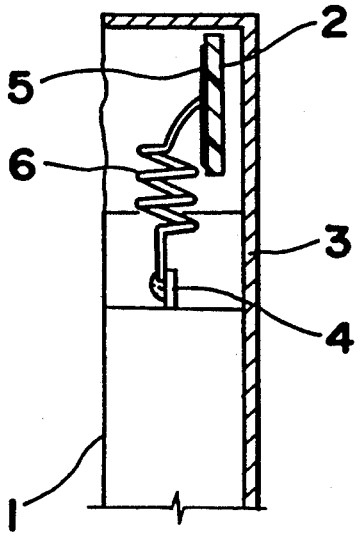
Fig. 11(B) PRIOR ART

Accordingly, the circuit construction of the embodiment as described so far becomes generally equivalent to that of the conventional band-pass filter explained with reference to FIG. 10, and in this band-pass filter of FIG. 2, the attenuation pole is to be set at the side of a frequency region higher than the pass-band frequency region thereof.

Figure 3:
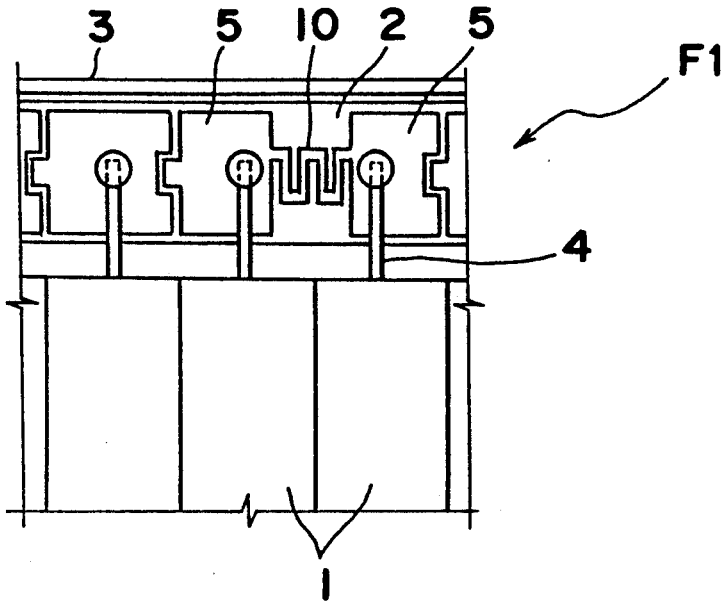

Referring further to FIG. 3, the actual construction of the band-pass filter according to one preferred embodiment of the present invention will be described hereinafter.

Figure 9A:
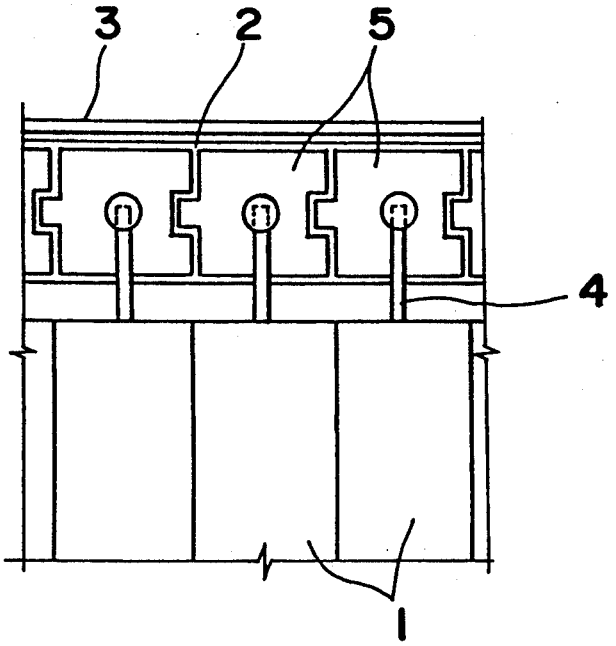
Fig. 9(A) PRIOR ART
FIG. 9(A) is a schematic top plan view showing an actual construction of the conventional band-pass filter of FIG. 8.
Figure 9B:
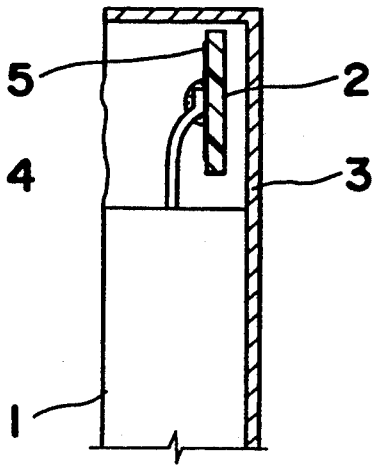
Fig. 9(B) PRIOR ART
FIG. 9(B) is a cross section of the conventional band-pass filter of FIG. 9(A)

It should be noted here that, in the arrangement of the present invention in FIG. 3, like parts in the conventional arrangement of FIGS. 9(A) and 9(B), etc. are designated by like reference numerals for brevity of explanation.

In FIG. 3, the band-pass filter F1 generally includes three dielectric coaxial resonators 1 as parallel resonance circuit elements arranged in a parallel relation side by side to be directed in the same direction, and respectively inserted with coupling terminals 4, a dielectric substrate 2 in a rectangular flat plate-like shape, and a case 3 for accommodating said resonators 1 and substrate 2 therein.

Figure 4:
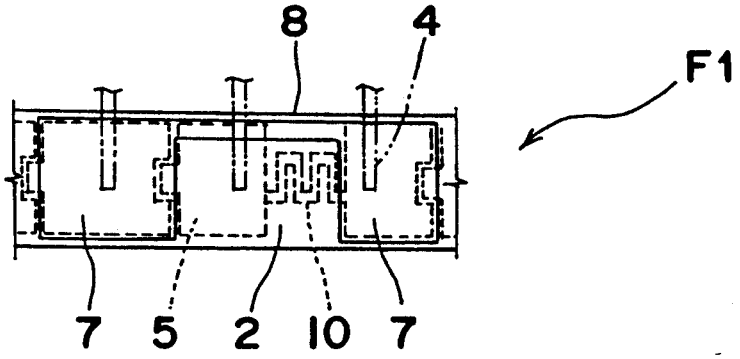

The dielectric substrate 2 is disposed at the open end side of the dielectric coaxial resonators 1 accommodated with the case 3 in the parallel relation to each other, and provided, on its first surface, with three coupling electrodes 5 formed along the direction of the coaxial resonators 1 arranged in the parallel relation, with predetermined intervals therebetween so as to be connected with the coupling terminals 4 respectively inserted in said coaxial resonators 1. Moreover, as shown in FIG. 4, on the reverse surface of said dielectric substrate 2 there are formed two confronting electrodes 7 facing the coupling electrodes 5 positioned at the opposite ends on the upper surface of said substrate, and connected to each other via a straight conducting line 8.

Furthermore, between one pair of the coupling electrodes 5 on the surface of the dielectric substrate 2, an inductance portion 10 in the form of a bent wiring pattern is formed by printing an electrically conductive paste or the like for connection of said coupling electrodes 5 to each other. In other words, this inductance portion 10 corresponds to the inductive coupling element L shown in FIG. 1, and is to be formed along the direction of the dielectric coaxial resonators 1 connected in the parallel relation in a similar manner as is the coupling electrode 5. Since the process of forming such a wiring pattern as referred to above is conventional, detailed description thereof is abbreviated here for brevity. Thus, the second end of the coupling terminal 4, which is inserted at its first end into each of the dielectric coaxial resonators 1 is fixed by soldering to each of the coupling electrodes 5.

Figure 5:
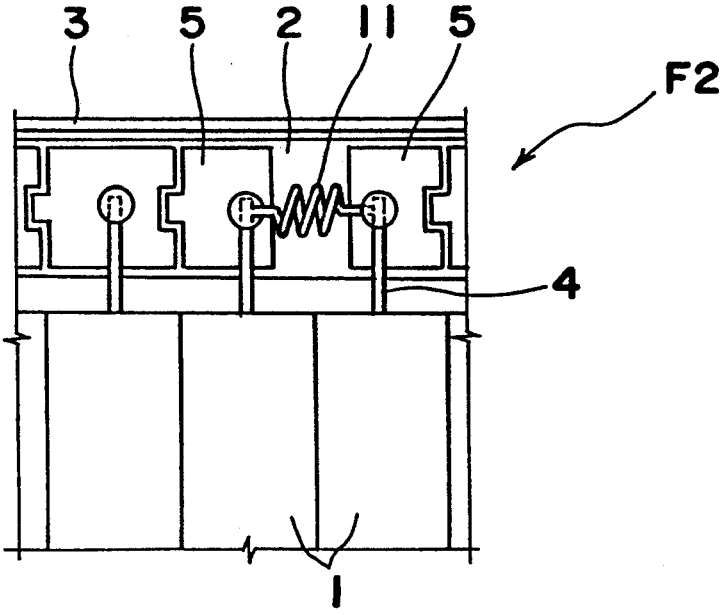

It should be noted here that, in the foregoing embodiment, although the inductive coupling element L in the circuit construction is described as realized by the inductance portion 10 formed between the coupling electrodes 5 on the surface of the dielectric substrate 2, the arrangement is not limited to the above, but may, for example, be so modified as in a band-pass filter F2 according to a second embodiment of the actual construction shown in FIG. 5, in which an air-core coil 11 as the inductance coupling element is mounted between the coupling electrodes 5 on the surface of the dielectric substrate 2 so as to connect said coupling electrodes 5 by respectively soldering the opposite ends of the air-core coil 11 to said electrodes 5. In the above arrangement of the modified band-pass filter F2 in FIG. 5, the air-core coil 11 is also to be mounted in the direction of the dielectric coaxial resonators 1 arranged in the parallel relation in a similar manner as is the inductance portion 11 of FIG. 3, and thus, the length of the band-pass filter F2 in the direction of its depth is not affected at all.

Incidentally, when the actual construction of the band-pass filter F2 for the second embodiment as described above is adopted, since the air-core coil 11 is mounted on the surface of the dielectric substrate 2, the length of the band-pass filter F2 in the direction of its height is undesirably increased, thus not meeting the requirement for a lower height of the band-pass filter.

Figure 6A:
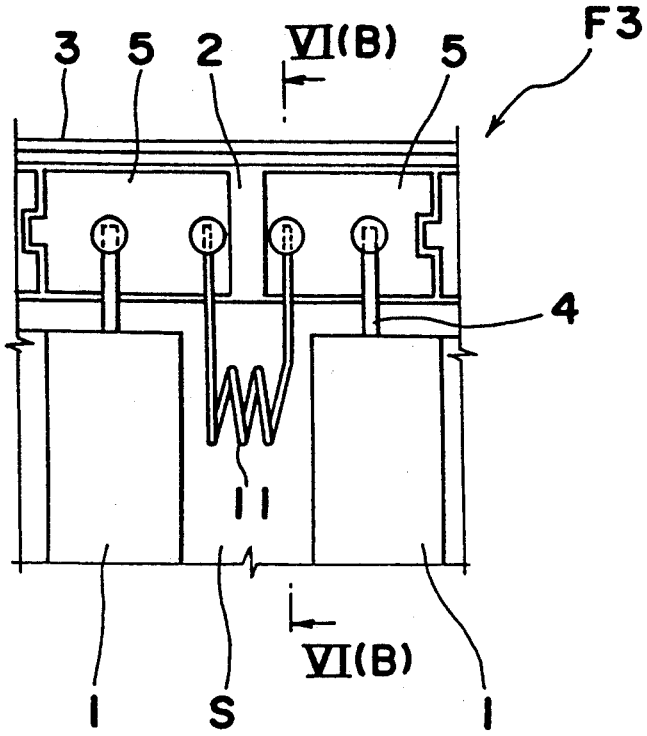
FIG. 6(A) is also a view similar to FIG. 3, which particularly relates to a third embodiment thereof.

In order to eliminate the disadvantage as described above, the arrangement may further be so modified, for example, as in a band-pass filter F3 according to a third embodiment shown in FIG. 6(A), in which a space or gap S of a predetermined width is provided between the dielectric coaxial resonators 1 disposed in parallel relation to each other, and the air-core coil 11 is disposed in said gap S. More specifically, by the above arrangement, as shown in FIG. 6(B), it becomes possible to set the position of the air-core coil 11 low, and consequently, reduction in the height of the band-pass filter may be readily achieved.

Figure 6B:
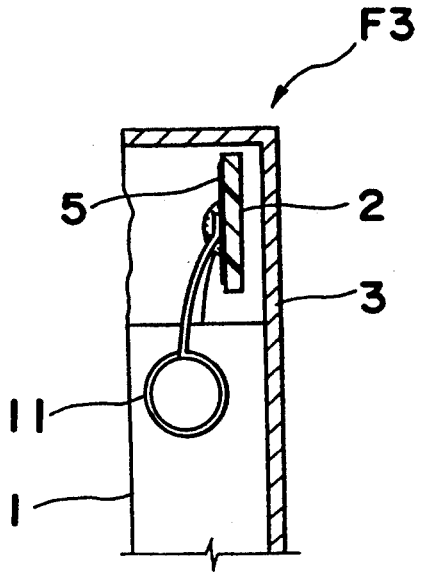
FIG. 6(B) is a cross section taken along the line VI(B-)—VI(B) in FIG. 6(A)
Figure 7:
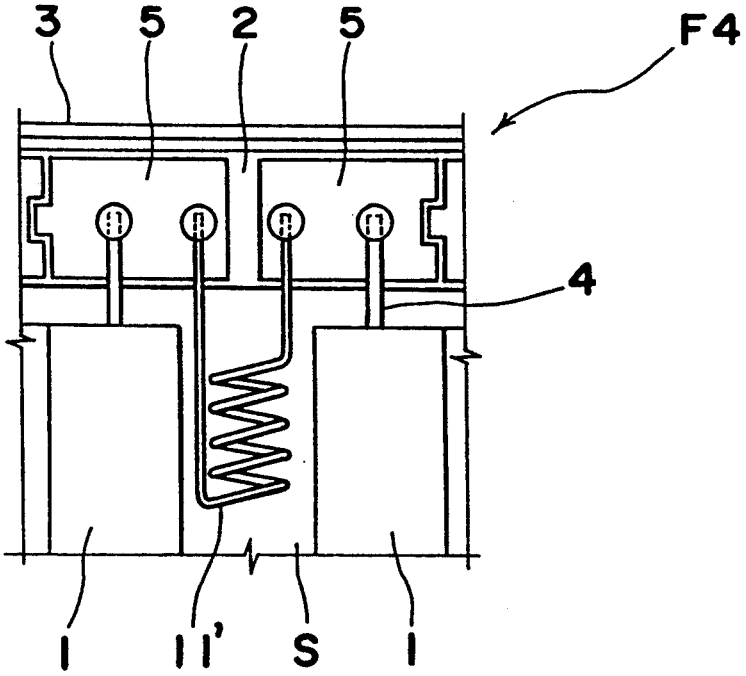
Figure 8:
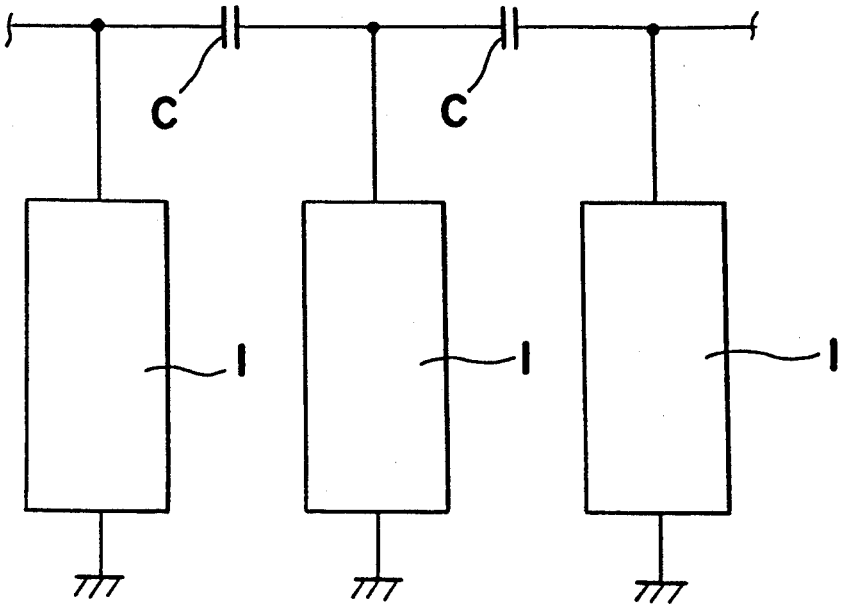
Fig. 8 PRIOR ART
FIG. 8 is an equivalent circuit diagram showing a fundamental circuit construction of a conventional band-pass filter.

Furthermore, the arrangement of FIGS. 6(A) and 6(B) may further be modified as in a modified band-pass filter F4 in FIG. 7, in which the air-core coil 11' is disposed in an axial direction of the dielectric coaxial resonator 1, i.e. in the direction of the depth of the band-pass filter, for reducing the height of said filter. In the case where the air-core coil 11 is disposed in such a direction as above, the number of turns of the air-core coil 11 may be readily increased more than that in the construction of FIGS. 6(A) and 6{B), and therefore, a larger inductance can be advantageously obtained.

As is clear from the foregoing description, by the circuit construction and actual construction of the band-pass filter according to the present invention, the coupling electrodes 5 to which the coupling terminals of the dielectric coaxial resonators as the parallel resonance circuit elements are connected, are formed on one surface of the dielectric substrate 2, along the direction of the dielectric coaxial resonators connected side by side in the parallel relation, and between these coupling electrodes, the inductance portion or the air-core coil as the inductance coupling element for setting the attenuation pole is provided. In the above case, since the interval between the coupling electrodes is not much different from that in the conventional arrangement, there is no tendency for the length of the band-pass filter in the direction of its depth to be increased by the provision of the inductance portion or the air-core coil.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A band-pass filter which comprises a plurality of a parallel resonance circuit element means, a coupling line, a bypass coupling line, and a dielectric substrate having first and second surfaces;

said coupling line including at least one capacitance coupling element means and at least one inductance coupling element means connected in series with each other at a first junction;

at least one of said parallel resonance circuit element means being connected, at a first end, to said first junction;

said bypass coupling line including a bypass capacitance coupling element means, and being connected in parallel with said coupling line;

said inductance coupling element means being located between at least one pair of said parallel resonance circuit element means;

said coupling line including a plurality of coupling electrodes on said first surface, a first one of said coupling electrodes forming said first junction, a second coupling electrode which confronts said first coupling electrode to form said capacitance coupling element means, and a third coupling electrode, said inductance coupling element means being connected in series between said first and third coupling electrodes; and said bypass capacitance coupling element means being formed by at least one confronting electrode on said second surface facing at least one of said second and third coupling electrodes through the dielectric substrate; and said bypass coupling line further comprising connecting means for connecting said bypass capacitance coupling element means to the other one of said second and third coupling electrodes.

2. A band-pass filter according to claim 1, wherein said connecting means includes a conductive line on said second surface of said dielectric substrate.

3. A band-pass filter according to claim 1, further comprising another said confronting electrode which faces the other of said second and third coupling electrodes through the dielectric substrate to form a second said bypass capacitance coupling element means which is comprised in said connecting means.

4. A band-pass filter according to claim 3, wherein said connecting means includes a conductive line on said second surface of said dielectric substrate.

5. A band-pass filter according to claim 1, wherein said pair of parallel resonance circuit element means are dielectric resonators which define a gap therebetween, and said inductance coupling element means is located in said gap.

6. A band-pass filter according to claim 5, wherein said dielectric resonators have respective dielectric bodies which define a volume in said gap therebetween, and said inductance coupling element means is located within said volume.

7. A band-pass filter according to claim 6, wherein said dielectric bodies of said resonators have respective axes which are arranged substantially parallel to each other.

8. A band-pass filter according to claim 7, wherein said inductance coupling element means includes a coil.

9. A band-pass filter according to claim 8, wherein said coil has an axis which is oriented substantially parallel to said axes of the dielectric bodies.

10. A band-pass filter according to claim 8, wherein said coil has an axis which is oriented transverse to said axes of the dielectric bodies.

11. A band-pass filter according to claim 8, wherein said coil is an air-core coil.

12. A band-pass filter comprising:

a plurality of dielectric coaxial resonators having respective coupling terminals;

a dielectric substrate with first and second surfaces;

a plurality of coupling electrodes formed on said first surface for interconnecting said respective coupling terminals; and inductance means connected to said coupling electrodes for connecting said coupling electrodes to each other;

said dielectric resonators having respective dielectric bodies which define a volume therebetween, said inductance means comprising a coil, and said coil being located within said volume.

13. A band-pass filter according to claim 12, wherein said dielectric bodies of said resonators have respective axes which are arranged substantially parallel to each other.

14. A band-pass filter according to claim 13, wherein said coil has an axis which is oriented substantially parallel to said axes of the dielectric bodies.

15. A band-pass filter according to claim 13, wherein said coil has an axis which is oriented transverse to said axes of the dielectric bodies.

16. A band-pass filter according to claim 13, wherein said coil is an air-core coil.

17. A band-pass filter comprising:

a plurality of dielectric coaxial resonators having respective coupling terminals;

a dielectric substrate with first and second surfaces;

a plurality of coupling electrodes formed on said first surface for interconnecting said respective coupling terminals; and inductance means located between said dielectric resonators and connected to said coupling electrodes for connecting said coupling electrodes to each other; and at least one confronting electrode facing at least one of said coupling electrodes formed on the second surface of said dielectric substrate so as to form a bypass capacitance; and means interconnecting said bypass capacitance and another one of said coupling electrodes so as to form a bypass coupling line connected in parallel with said coupling electrodes.

18. A band-pass filter according to claim 17, further comprising another said confronting electrode which faces another respective one of said coupling electrodes through the dielectric substrate to form a second said bypass capacitance which is also comprised in said bypass coupling line.

19. A band-pass filter according to claim 18, wherein said interconnecting means includes a conductive line on said second surface of said dielectric substrate.

* * * * *